United States Patent [19]

Wyslotsky

[11] Patent Number: 5,044,495

[45] Date of Patent: Sep. 3, 1991

[54] MULTIPLE COMPONENT PRESSURIZED PACKAGE FOR ARTICLES AND METHODS OF PRESSURIZATION THEREOF

[75] Inventor: Ihor Wyslotsky, Rolling Meadows, Ill.

[73] Assignee: Redex Packaging Corp., Rolling Meadows, Ill.

[21] Appl. No.: 543,033

[22] Filed: Jun. 25, 1990

[51] Int. Cl.[5] ..... B65D 85/00

[52] U.S. Cl. ..... 206/315.9; 206/461; 206/497; 206/526

[58] Field of Search ..... 206/213.1, 315.9, 461, 206/471, 470, 462, 467, 497, 526, 469; 220/4 B

[56] References Cited

U.S. PATENT DOCUMENTS

| | | | |
|---|---|---|---|
| 3,943,989 | 3/1976 | Sperling | 206/470 |
| 4,020,948 | 3/1977 | Won | 206/315.9 |
| 4,244,470 | 1/1981 | Burnham | 220/4 B |
| 4,377,234 | 3/1983 | Kaplan | 206/497 |
| 4,491,221 | 1/1985 | Lange | 220/4 B |
| 4,671,406 | 6/1987 | Baer | 206/315.9 |
| 4,706,839 | 11/1987 | Spence | 206/497 |
| 4,729,472 | 3/1988 | Lubin et al. | 206/315.9 |
| 4,793,394 | 12/1988 | Cohen | 206/315.9 |

*Primary Examiner*—David T. Fidei

*Attorney, Agent, or Firm*—Allegretti & Witcoff, Ltd.

[57] ABSTRACT

The multiple component pressurized package of the present invention in general includes two components:

a polymeric inner package component; and a sleeve disposed tightly around the polymeric inner package component.

The polymeric inner package component includes at least one sealed compartment for containing therein the package. The compartment is maintained under a pressure which is substantially above that of atmospheric pressure, such as may be useful for example in packaging articles which themselves must be maintained under pressure. The sleeve is positioned in snug circumferential disposition about at least a substantial portion of the inner package component. The sleeve may preferably be made of a polymeric material. Such sleeve compressively contains the inner package component while the inner package component is maintained under pressure. Upon the release of pressure from the polymeric inner package component, the sleeve may then be slideably removed therefrom.

23 Claims, 2 Drawing Sheets

Fig.1
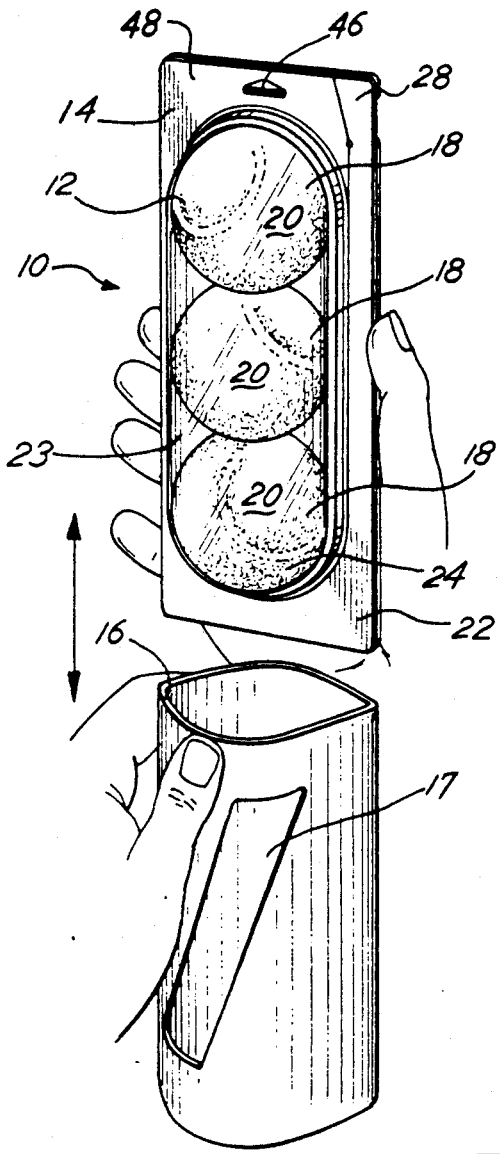
Fig.2
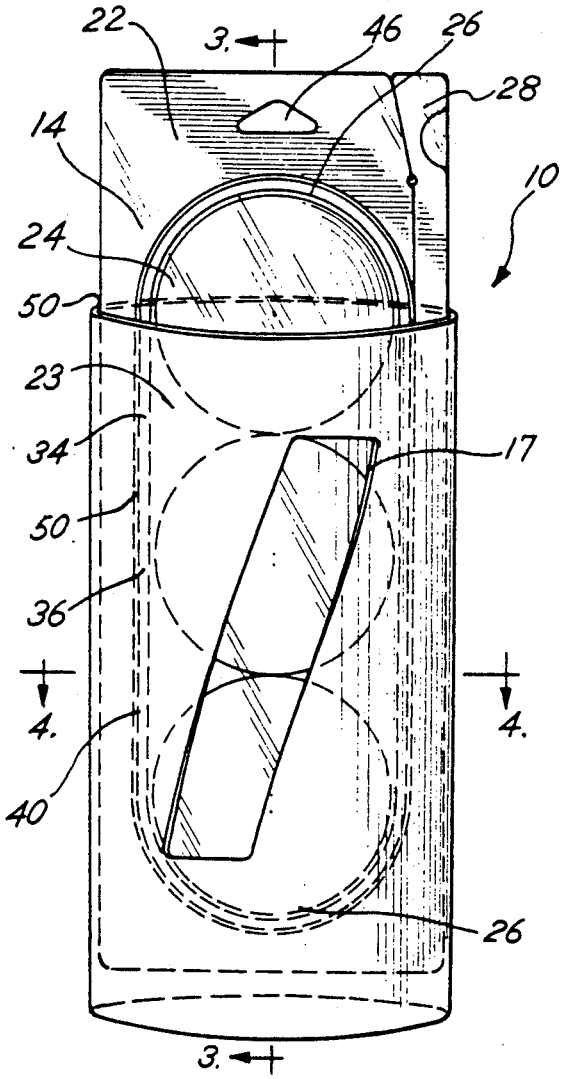
Fig.4
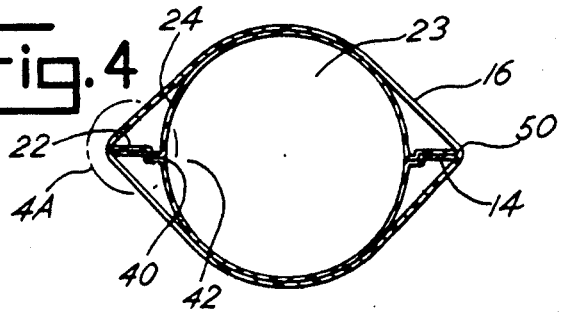
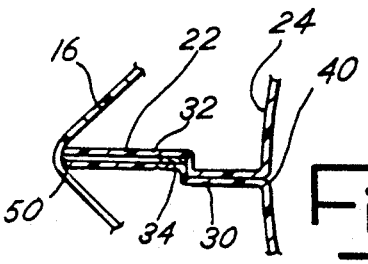
Fig.4A

Fig. 3
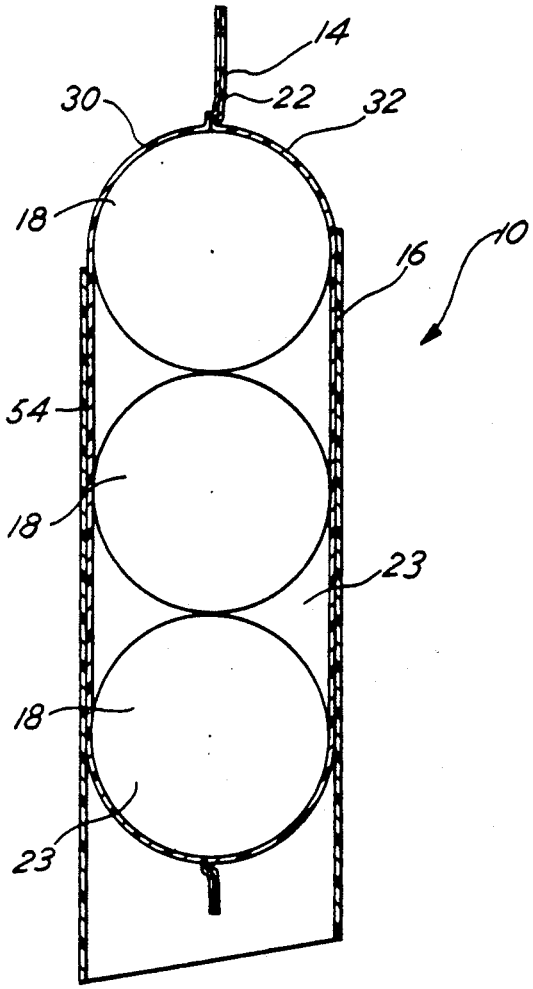
Fig. 6
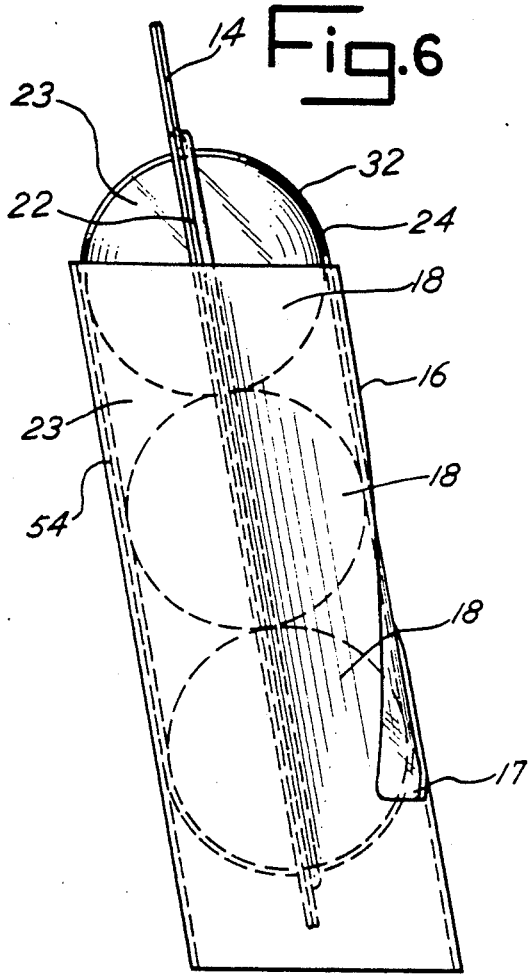
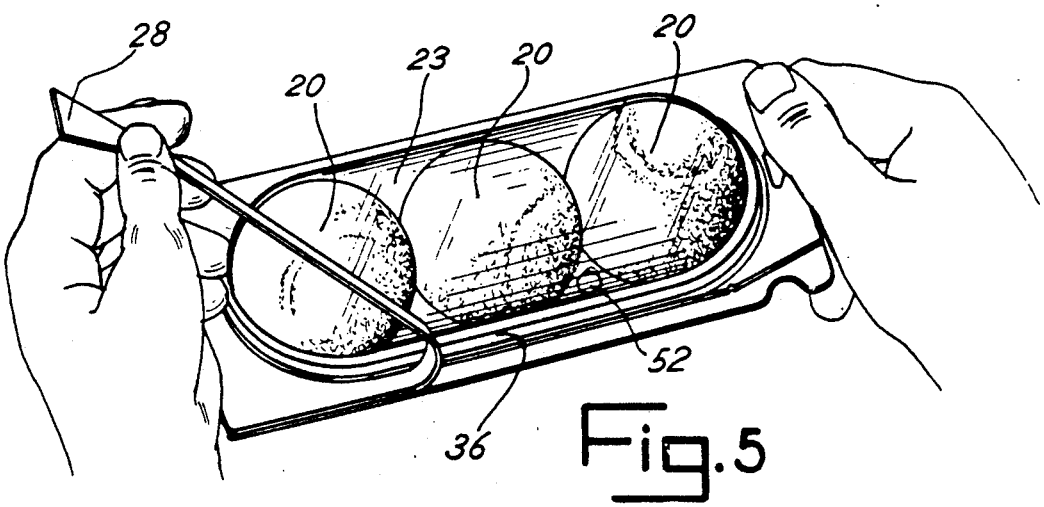
Fig. 5

MULTIPLE COMPONENT PRESSURIZED PACKAGE FOR ARTICLES AND METHODS OF PRESSURIZATION THEREOF

BACKGROUND OF THE INVENTION

The present invention relates generally to packaging materials, and more particularly to a multiple component pressurized package for certain articles, which may in some embodiments be pressurized articles, such as for example, tennis balls.

In the prior art, certain types of packaging have been developed for purposes of maintaining the contents thereof under a pressure substantially above atmospheric pressure. This type of packaging has been particularly necessitated where it is necessary that the contents of the package be maintained under pressure until use. Of course, such packaging has had various requirements, inter alia, including the maintenance of such pressure over long periods of time.

In order to maintain pressure over a long period of time, such prior art packaging materials have necessitated the use of sturdy and frequently not inexpensive materials and structures, the fabrication and use of which often necessitated the purchase, maintenance, and use of expensive equipment. For example, prior art tennis ball packages have included pressurized metal cans, pressurized clear P.E.T. packaging in the shape and format of a metal can but molded from plastic, etc.

In view of the difficulties and deficiencies with prior art devices, it is an object of the present invention materially to alleviate such difficulties and deficiencies by providing a multiple component pressurized package for such articles, as set forth in greater detail hereinbelow.

SUMMARY OF THE INVENTION

The multiple component pressurized package of the present invention in general includes two components:

a polymeric inner package component; and a sleeve disposed tightly around the polymeric inner package component.

The polymeric inner package component includes at least one sealed compartment for containing therein the package. The compartment is maintained under a pressure which is substantially above that of atmospheric pressure, such as may be useful for example in packaging articles which themselves must be maintained under pressure. The sleeve is positioned in snug circumferential disposition about at least a substantial portion of the inner package component. The sleeve may preferably be made of a polymeric material. Such sleeve compressively contains the inner package component while the inner package component is maintained under pressure. Upon the release of pressure from the polymeric inner package component, the sleeve may then be slidably removed therefrom.

The multiple component pressurized package for articles of the present invention may be pressurized by the addition of a large molecular size and preferably inert gas (such as, for example, argon) in liquid form with a retardant for gasification. Alternatively, the large molecular size gas in liquid form may be placed within the container and in particular within the polymeric inner package component of the container in pellet form. The polymeric inner package component is then sealed, and the liquified gas is gasified by various means, such as for example, the application of heat to the entire package, or the use of microwave or UV energy to trigger dissolution of the pellet or breakdown of the retardant or gasification.

In other preferred embodiments, the sleeve may be disposed about the polymeric inner package component. Such sleeve may be made of a heat shrink material, which upon the application of heat shrinks simultaneously with the gasification of the liquified gas. By such means, the diameter of the polymeric inner package component is effectively increased, and the diameter of the sleeve is effectively decreased to create a snug fit. Such pressurization by means of gasification of the liquified gas, and more particular the amount thereof, are controlled by the amount of liquified gas which has been placed within the sealed polymeric inner package component.

These and other aspects and embodiments of the multiple component pressurized package for articles of the present invention will become more apparent upon review of the brief description of the drawing, detailed description of the preferred embodiments, opinion claims and accompanying drawings.

BRIEF DESCRIPTION OF THE DRAWINGS

The multiple component pressurized package for articles of the present invention is depicted in the accompanying drawing, and in which:

FIG. 1 is a perspective view of the polymeric inner package component and the surrounding sleeve, with the polymeric inner package component being slidably disposed within such sleeve for compressive containment therein, and for removal therefrom upon release of such pressure;

FIG. 2 is a plan view of the multiple component pressurized package for articles of the present invention showing such at least partial containment of the polymeric inner package component by the surrounding sleeve, and showing the tab for release of pressure from within the polymeric inner package component;

FIG. 3 is a side view taken along line 3—3 of FIG. 2, and showing the sleeve thereof which is rhomboidally shaped in longitudinal cross-section in order to form angled stacking of a plurality of the packages;

FIG. 4 is a transverse cross-sectional view taken along line 4—4 of FIG. 3 and showing the eye-shaped cross-sectional shape of the sleeve which compressively contains the polymeric inner package component and which in preferred embodiments is disposed snugly about at least substantial portions of the sealed compartment of the polymeric inner package component, and which also engages the lateral edge portions of the peripheral portion of the package which is substantially planar in planed view shape;

FIG. 4A is a greatly enlarged view of the portion designated as 4A in FIG. 4;

FIG. 5 is a perspective view of the multiple component pressurized package for articles showing the opening of the polymeric inner package component which has been removed from the sleeve, such opening being performed by means of a pull-tab which releases the pressure contained within the package, and thereafter a gasket if used disposed around the sealed area may be removed and discarded; and FIG. 6 is a side view of the multiple component pressurized package for articles of the present invention showing the filling of the tilted bottom for angled stacking of the package, and further showing at the bottom thereof a pellet or other inner container for containing liquified gas for release to pressurize the inner package component, such as for example upon the application of heat thereto.

DETAILED DESCRIPTION OF PREFERRED EMBODIMENTS

The multiple component pressurized package for containing articles in preferred embodiments of the present invention includes in general a two component, mutually interactive packaging system. In particular, a polymeric inner package component is disposed within a snugly fitting externally disposed sleeve. The polymeric inner package component includes at least one sealed compartment for containing therein the article which is to be packaged. The sealed compartment is maintained under substantial pressure which is above atmospheric pressure, such as may be necessary. For example, in certain embodiments hereof, the package items themselves are pressurized. In particular, the multiple component pressurized package for articles of the present invention has found substantially utility in the packaging of tennis balls.

The sleeve disposed around the polymeric inner package component fits in snug array circumferentially thereabout. Such sleeve compressively contains the inner package component while the inner package component is maintained under pressure.

The inner package component comprises in some preferred embodiments a peripheral portion which is substantially planar and a centrally disposed portion which has a substantial thickness for containing the packaged article. In embodiments of the present invention intended for packaging tennis balls, the pressurized compartment of the inner packaging component is preferably oblong in transverse cross-sectional shape, with the end portions thereof being substantially semi-circular in shape, and of such a size and shape to contain the tennis balls therewithin.

The sleeve component may be substantially cylindrical in its unassembled state, but becomes substantially eye-shaped in transverse cross-sectional view when disposed into its assembled state.

The pressurized inner package component includes in other preferred embodiments a manually grippable pull-tab for releasing the pressure contained within the polymeric inner package component. Such inner package component preferably includes first and second container portions which are disposed in joined array for containing the packaging component therewithin. Such first and second container portions may be sealingly joined by a gasket disposed therebetween. The first and second container portions also may preferably include a lip disposed therearound at the periphery of the opening of such first and second container portions. Such lip portion may be joined to a peel mechanism of the container for opening the container. Such lip disposed on the first and second container portions may include recloseable means for stably rejoining and reclosing the first and second container portions of the inner package component after opening thereof.

The sleeve means is preferably made of a polymeric material, which may comprise in certain embodiments a heat shrink material.

The first and second container portions also preferably include a volume for, upon joinder thereof together, containing the packaging article within such volume. One of the inner package components or the sleeve includes a hanging means for suspending the package for display in preferred embodiments. Such hanging means may comprise an aperture therein. In preferred embodiments the aperture is disposed upon the upper portion of the inner package component for hanging the package or otherwise suspending the package from a spindle. In preferred embodiments, the sleeve, when in its assembled state, is in substantial contact with the lateral edges of the peripheral portion of the inner package component. Such inner package component is pressurized to at least approximate 13 psi, and in some embodiments 15 p.s.i.

At least one of the inner package component and the sleeve means is preferably made of recyclable materials. Such recyclable materials may preferably comprise a polyester based laminate material.

Other aspects of the present invention are directed to a method of pressurizing a multiple component package, such package having a polymeric inner package component and a sleeve for snug disposition therearound. Such method of the present invention comprises in broad aspects thereof the steps of disposing the content to be packaged within the polymeric inner package component. The next step is to introduce a liquified gasing to the polymeric inner gas component. The polymeric inner package component is then sealed, and the sleeve is disposed upon the inner package component. Finally, the liquified gas is gasified to pressurize the polymeric inner package component in a more snug array. In such preferred embodiments of the pressurizing a multiple component package the liquified gas is preferably an inert gas. Such liquified gas preferably comprises a gas of large molecular size for minimization of depressurization by diffusion through the polymeric inner package component. One example of such liquified gas in preferred embodiments is argon.

Such liquified gas is in other preferred embodiments treated with a gasification retardant prior to introduction thereof into the polymeric inner package component. Although several means of such treatment are known in the prior art, one example is the incapsulation of the liquified gas prior to such introduction thereof into the polymeric inner package component.

In certain other preferred embodiments, the liquified gas may be heated to achieve gasification thereof. Such heating of the liquified gas may be carried out by means of microwave energy, ultraviolet energy, or other forms of electromagnetic energy thereto.

The sleeve of heat shrink material may be preferably shrunk upon the application of heat thereto to effectuate shrinking of the sleeve around the polymeric inner package component. In preferred embodiments, the effective diameter of the polymeric inner package component is effectively increased by application of heat thereto and simultaneously therewith the effective diameter of the sleeve of heat shrink material is decreased also by the application of heat.

In certain other preferred embodiments the polymeric inner package component may be substantially presealed, except for a space sufficient to permit introduction of the liquidified gas therein, which step is carried out after disposition of the contents to be packaged within the polymeric inner package component.

A number of distinctive advantages are created by the utilization of the method and apparatus of the present invention. In particular, the sleeve holds the multiple component pressurized package together as long as there is pressure inside the polymeric inner package component. When the pressure is removed from the polymeric inner package component, the pressurized compartment thereof collapses, and allows the sleeve to be easily removed. Thus, if the sleeve appears to be loosely disposed about the polymeric inner package component, the consumer in observing that condition is thereby advised that the package has lost its pressure and should not be sold, purchased or used. Accordingly, the sleeve mechanism serves as an indicator of usefulness of the package and freshness of the contents, and strictly indicates whether the tennis balls have been maintained in a continuing pressurized condition. Under normal use by the consumer, as described hereinabove, the pull-tab is lifted. The lifting of the peel tab releases the pressure from inside the pressurized compartment of the polymeric inner package component, which causes a slight collapse and diminution in diameter of the compressurized compartment thereof. Such decrease in diameter allows for the sleeve to be removed, whereupon the user can continue stripping the seal from the periphery of the polymeric inner package component, thereby to open the package.

A line of reduced strength may be set forth at the back of the sleeve to provide alternative means to the consumer for breaking the sleeve, if necessary, in alternative mechanisms for opening the package.

Of course, the multiple component pressurized package for articles of the present invention may be utilized for the packaging of comestible products, as well as for the packaging of tennis balls.

Referring now to the drawing, the multiple component pressurized package generally 10 for containing articles 12 in preferred embodiments of the present invention includes in general a two component, mutually interactive packaging system. In particular, a polymeric inner package component 14 is disposed within a snugly fitting externally disposed sleeve 16. Polymeric inner package component 14 includes at least one sealed compartment 18 for containing therein the article 12 which is to be packaged. Multiple compartments 18, 18, 18 are shown in FIGS. 1 and 6 in particular. Sealed compartment 18 is maintained under substantial pressure which is above atmospheric pressure, such as may be necessary. For example, in certain embodiments hereof, the packaged articles 12 themselves are pressurized. In particular, the multiple component pressurized package for articles of the present invention has found substantially utility in the packaging of tennis balls 20.

Sleeve 16 having a clear window area 17 is disposed around polymeric inner package component 14 and fits in snug array circumferentially thereabout, as shown particularly in FIGS. 2, 3 and 4. Such sleeve 16 compressively contains inner package component 14 while inner package component 14 is maintained under pressure.

Inner package component 14 comprises in some preferred embodiments a peripheral portion 22 which is substantially planar and a centrally disposed portion 24 which has a substantial thickness for containing packaged article 12. In embodiments of the present invention intended for packaging tennis balls 20, the pressurized compartment 23 of inner packaging component 14 is preferably oblong in transverse cross-sectional shape, with end portions 26 thereof being substantially semicircular in shape as shown in FIG. 2, and of such a size and shape to contain tennis balls 20 therewithin.

Sleeve 16 may be substantially cylindrical in its unassembled state, but becomes substantially eye-shaped in transverse cross-sectional view when disposed into its assembled state as shown in FIG. 4.

Pressurized inner package component 14 includes in other preferred embodiments a manually grippable pull-tab 28 for releasing the pressure contained within polymeric inner package component 14, as shown in FIGS. 1, 2 and 5. Such inner package component 14 preferably includes first and second container portions 30, 32 which are disposed in joined array for containing the packaged article therewithin. Such first and second container portions 30, 32 may be sealingly joined by a gasket 34 disposed therebetween as shown in FIGS. 1 and 2. First and second container portions 30, 32 also may preferably include a lip 36 is shown in FIGS. 4 and 4A, disposed therearound at the periphery 40 of the opening 42 of such first and second container portions 30, 32. Such lip 36 may be joined to a peel mechanism 38 of the inner package component 14 for opening inner package component 14. Such lip 36 disposed on first and second container portions 30, 32 may include reclosable means for stably rejoining and reclosing first and second container portions 30, 32 of inner package component 14 after opening thereof.

Sleeve 16 is preferably made of a polymeric material, which may comprise in certain embodiments a heat shrink material.

First and second container portions 30, 32 also preferably include a volume for, upon joinder thereof together, containing packaged article 12 within such volume. One of inner package component 14 or sleeve 16 includes a hanging mechanism 44 for suspending the package 10 for display in preferred embodiments. Such hanging mechanism 44 may comprise an apeture 46 therein as shown in FIGS. 1 and 2. In preferred embodiments aperture 46 is disposed upon upper portion 48 of inner package component 14 for hanging package 10 or otherwise suspending package 10 from a spindle. In preferred embodiments, sleeve 16, when in its assembled state, is in substantial contact with lateral edges 50 of peripheral portion 22 of inner package component 14, as shown in FIGS. 2 and 4. Such inner package component 14 is pressurized to at least approximate 13 p.s.i., and in some embodiments 15 p.s.i.

At least one of the inner package component 14 and sleeve 16 is preferably made of recyclable materials. Such recyclable materials may preferably comprise a polyester-based laminate material.

Other aspects of the present invention are directed to a method of pressurizing a multiple component package 10, such package 10 having a polymeric inner package component 14 and a sleeve 16 for snug disposition therearound. Such method of the present invention comprises in broad aspects thereof the steps of disposing the contents or article 12 to be packaged within polymeric inner package component 14. The next step is to introduce a liquified gas into the polymeric inner gas component 14. Polymeric inner package component 14 is then sealed, and sleeve 16 is disposed upon inner package component 14. Finally, the liquified gas is gasified to pressurize polymeric inner package component 14 in a more snug array, as shown, for example by the disposition of elements depicted in FIG. 4. In such preferred embodiments of pressurizing multiple component package 10, the liquified gas is preferably an inert gas. Such liquified gas preferably comprises a gas of large molecular size for minimization of depressurization by diffusion through polymeric inner package component 14. One example of such liquified gas in preferred embodiments is argon.

Such liquified gas is in other preferred embodiments treated with a gasification retardant prior to introduction thereof into the polymeric inner package component. Although several means of such treatment are known in the prior art, one example is the encapsulation of the liquified gas prior to such introduction thereof into polymeric inner package component 14. Such a capsule 52 is shown schematically in FIG. 6.

In certain other preferred embodiments, the liquified gas may be heated to achieve gasification thereof. Such heating of the liquified gas may be carried out by means of microwave energy, ultraviolet energy, or other forms of electromagnetic energy thereto.

Sleeve 16 of heat shrink material may be preferably shrunk upon the application of heat thereto to effectuate shrinking of sleeve 16 around polymeric inner package component 14. In preferred embodiments, the effective diameter of polymeric inner package component 14 is effectively increased by application of heat thereto and simultaneously therewith the effective diameter of sleeve 16 of heat shrink material is decreased also by the application of heat.

In certain other preferred embodiments polymeric inner package component 14 may be substantially presealed, except for a space sufficient to permit introduction of the liquidified gas therein, which step is carried out after disposition of the contents to be packaged within polymeric inner package component 14.

A number of distinctive advantages are created by the utilization of the method and apparatus of the present invention. In particular, sleeve 16 holds multiple component pressurized package 14 together as long as there is pressure inside polymeric inner package component 14. When the pressure is removed from polymeric inner package component 14, the pressurized compartment 23 thereof collapses, and allows sleeve 16 to be easily removed. Thus, if sleeve 16 appears to be loosely disposed about polymeric inner package component 14, the consumer in observing that condition is thereby advised that the package 10 has lost its pressure and should not be sold, purchased or used. Accordingly, sleeve 16 serves as an indicator of usefulness of package 10 and freshness of the contents or packaged article 12, and strictly indicates whether tennis balls 20 have been maintained in a continuing pressurized condition. Under normal use by the consumer, as described hereinabove, pull-tab 28 is lifted. The lifting of the pull-tab 28 releases the pressure from inside pressurized compartment 23 of polymeric inner package component 14, which causes a slight collapse and diminution in diameter of pressurized compartment 23 thereof. Such decrease in diameter allows for sleeve 16 to be removed, whereupon the user can continue stripping seal 34 from periphery 22 of polymeric inner package component 14, thereby to open the package.

A line of reduced strength 54 may be set forth at the back of sleeve 16 to provide alternative means to the consumer for breaking sleeve 16, if necessary, in alternative mechanisms for opening package 10, as shown in FIG. 6.

Of course, multiple component pressurized package 10 for articles 12 of the present invention may be utilized for the packaging of comestible products, as well as for the packaging of tennis balls 20.

Polymeric inner package component 14 may be formed of acrylics, polyvinyl chlorides, PET, or other polymeric materials. A barrier layer of polyester or other materials known to those of ordinary skill in the art may be laminated to the primary or base layer. In such case, a tie layer may be disposed therebetween. Such tie layer may comprise an ethyl-vinyl acetate/linear low density polyethylene blend, in blends of approximately 18%–26% in some embodiments, depending upon the peel strength required. Finally, a sealant layer including anti-fog, anti-block, and peelable and/or other properties may be disposed atop the barrier layer to comprise a laminate of (from the outside inwardly) a primary plastic layer, a tie layer, a barrier layer, and a sealant layer. Finally, two such laminates may be sealed together with sealant layers disposed face-to-face such as for example at the joiner of the first and second container portions 30, 32, at least one of which may contain a peel mechanism. Thus, such peel mechanism serves to separate the two sealant layers form each other to effectuate the strippable opening of package 10.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. A multiple component pressurized package for articles comprising:

a polymeric inner package component including at least one sealed compartment for containing therein the articles, said compartment maintained under pressure above atmospheric pressure; and separate sleeve means disposed longitudinally slideably, non-sealingly, and circumferentially about at least a substantial portion of said inner package component for compressively containing said inner package components while said inner package component is maintained under pressure.

2. The multiple component pressurized package for articles of claim 1 further comprising a packaged article which itself is pressured above atmopheric pressure.

3. The multiple component pressurized package for articles of claim 2 wherein said pressurized packaged article comprises a tennis ball.

4. The multiple component pressurized package for articles of claim 1 wherein said inner package component comprises a peripheral portion which is substantially planar and a central portion which has a substantial thickness for containing the packaged article.

5. The multiple component pressurized package for articles of claim 1 wherein said sleeve means is substantially cylindrical in its unassembled state.

6. The multiple component pressurized package for articles of claim 1 wherein said sleeve means is substantially eye-shaped in transverse cross-section when in its assembled state.

7. The multiple component pressurized package for articles of claim 1 wherein said pressurized inner package component includes manually grippable pull tab means for releasing the pressure contained within said inner packaged component.

8. The multiple component pressurized package for articles of claim 1 wherein said inner package component comprises first and second container portions disposed in joined array for containing the packaged article therewithin.

9. The multiple component pressurized package for articles of claim 8 wherein said inner package component includes peel means for opening said inner package component by separating said first and second container portions.

10. The multiple component pressurized package for articles of claim 8 wherein said first and second container portions are sealingly joined together by gasket means disposed therebetween.

11. The multiple component pressurized package for articles of claim 8 wherein said first and second container portions are oblong in transverse cross-sectional shape.

12. The multiple component pressurized package for articles of claim 9 wherein one of said first and second container portions includes a lip disposed around the periphery of the opening thereof and said lip portion is joined to said peel means.

13. The multiple component pressurized package for articles of claim 12 wherein said lip includes reclosable means for stabilely rejoining and reclosing said first and second container portions of said inner package component after opening thereof.

14. The multiple component pressurized package for articles of claim 1 wherein said sleeve means is made of a polymeric material.

15. The multiple component pressurized package for articles of claim 8 wherein each of said first and second container portions includes upon joinder thereof together a volume for containing the packaged article within said volume.

16. The multiple component pressurized package for articles of claim 1 wherein one of said inner package components and said sleeve means includes hanging means for suspending the package for display.

17. The multiple component pressurized package for articles of claim 16 wherein said hanging means comprises an aperture therein.

18. The multiple component pressurized package for articles of claim 17 wherein said aperture is contained within the upper portion of said inner package component.

19. The multiple component pressurized package for articles of claim 1 wherein said sleeve means when in its assembled state is in substantial contact with the lateral edges of said inner package component.

20. The multiple component pressurized package for articles of claim 1 wherein said inner package component is pressurized to at least approximately 13 psi.

21. The multiple component pressurized package for articles of claim 1 wherein at least one of said inner package component and said sleeve means is made of recyclable materials.

22. The multiple component pressurized package for articles of claim 21 wherein said recyclable materials comprise a polyester-based barrier laminate material.

23. The multiple component pressurized package for articles of claim 1 wherein the sleeve means is made of a heat shrinkable material.

* * * * *